US006126036A

United States Patent [19]

d'Alayer de Costemore d'Arc et al.

[11] Patent Number: 6,126,036

[45] Date of Patent: Oct. 3, 2000

[54] APPARATUS FOR DISPENSING ARTICLES

[75] Inventors: Stephane M. A. d'Alayer de Costemore d'Arc, Genappe; Jean-Claude Dombret, Braine-L'Alleud, both of Belgium

[73] Assignee: Staar S.A., Brussels, Belgium

[21] Appl. No.: 09/156,653

[22] Filed: Sep. 18, 1998

[30] Foreign Application Priority Data

Sep. 24, 1997 [BE] Belgium ..... 9700776

[51] Int. Cl.[7] ..... B65H 3/36

[52] U.S. Cl. ..... 221/253; 221/123

[58] Field of Search ..... 221/253, 259, 221/210, 123, 92, 131, 197

[56] References Cited

U.S. PATENT DOCUMENTS

| | | | |
|---|---|---|---|
| 3,893,589 | 7/1975 | Mandell | 221/123 |
| 4,423,827 | 1/1984 | Guigan | 221/129 |
| 5,048,719 | 9/1991 | Empl et al. | 221/253 |

FOREIGN PATENT DOCUMENTS

| | | |
|---|---|---|
| 0647927 | 4/1995 | European Pat. Off. . |
| 2723656 | 2/1996 | France . |
| 2209331 | 5/1989 | United Kingdom . |
| 2305659 | 4/1997 | United Kingdom . |

*Primary Examiner*—Kenneth W. Noland
*Attorney, Agent, or Firm*—Leydig, Voit & Mayer, Ltd.

[57] ABSTRACT

Apparatus for dispensing articles of regular shape, such as boxes, from adjacent compartments in which articles are stored in stacks, each of the compartments having a bottom aperture. A dispensing device is mounted below for movement in-between the compartments and includes a mobile carriage supported on guiding members to translate forward-and-back below one compartment when positioned therebelow. A reversible electric motor is connected to the carriage by a timing pulley and belt drive including a timing pulley attached to a control shaft on the carriage. A pair of fingers are mounted to the rotary control shaft. The mobile carriage is translated forward-and-back by the motor by rotating the carriage-pulley in one direction which raises the fingers where they are engageable with the lowermost article in the one compartment and then translates the carriage forward to dispense it through a bottom aperture in the compartment and reversing the motor to rotate the carriage-pulley in the opposite direction which lowers the fingers to a lower level where they are free of the compartments. Rollers are mounted on the outer end of the fingers so that a penultimate article is engaged and lifted by the rollers to raise the stack from fully bearing on the lowermost article as the lowermost article is engaged by the fingers and translated through the aperture. The control shaft shifts the fingers between their lower and upper levels depending on direction of forward-and-back movement of the carriage.

17 Claims, 5 Drawing Sheets

APPARATUS FOR DISPENSING ARTICLES

FIELD OF THE INVENTION

The present invention relates to apparatus for dispensing articles of regular shape and, more particularly, to devices for dispensing articles from storage compartments and distribution to the user. As used herein, the term article designates any article of regular shape such as, for example, a box, can, container for objects such as discs or cassettes which comprise information supports, as well as for cassettes, cartridges for magnetic tape, magnetic or optical disc, and the like.

BACKGROUND OF THE INVENTION

Dispensing apparatus presently available on the market are of mainly two types: the first one being of the so-called "drawer" type where articles are stored vertically one above the other in adjacent compartments, each one including at its lower level a drawer powered to remove the article located at the bottom of the compartment or stack, the second one of the so-called "screw" type where the articles are stored horizontally in adjacent compartments in the form of tunnels which are separated from each other by each convolution of an endless screw, the rotation of the endless screw dispensing outside the compartment or tunnel the article located at its front end. Each storage compartment requiring its own mechanism, a drawer or an endless screw, those dispensing apparatus become costly to manufacture when they incorporate several compartments. Further, safety means are mandatory to make sure that only one object can be removed from one compartment at a time.

SUMMARY OF THE INVENTION

The principal object of the present invention is to overcome those drawbacks by providing a dispensing device ensuring the dispensing and distribution of articles stored in stacks in distinct, adjacent compartments, with the use of minimum force applied against the articles to avoid damage to the articles or their packaging.

A further object of the invention is to provide a dispensing device movable between an active position in which it dispenses an article from a compartment and an inactive position in which the dispensing device and the adjacent compartments can be shifted relatively to position the dispensing device below a selected compartment.

A further object of the invention is to provide a dispensing device which is simple in construction and reliable in operation.

A further object of the invention is to provide an autonomous dispensing device.

A further object of the invention in to provide a dispensing device which easily handles articles of various thicknesses.

To achieve the foregoing objects, the dispensing apparatus according to the invention comprises adjacent vertical compartments in which articles are stored in stacks, each of the compartments having a bottom aperture, a dispensing device mounted below the compartments, the compartments and the dispensing device being supported for relative movement to position the dispensing device below any one of the compartments and allow the dispensing device to translate the lowermost article in a stack in said one compartment through the aperture to dispense the lowermost article from the compartment, and wherein the dispensing device includes a mobile carriage supported on guiding members for translation forward-and-back below said one compartment when positioned therebelow, a finger mounted on the mobile carriage for movement between a lower level where it is disengaged from the compartments and an upper level where it is engageable with to translate the lowermost article in said one compartment and dispense it through the aperture upon forward translation of the mobile carriage, a roller mounted on an end portion of the finger so that a penultimate article is engaged and lifted by the roller to raise the stack from fully bearing on the lowermost article as the lowermost article is engaged by the finger and translated toward the aperture, and an actuator on the mobile carriage which shifts the finger between its low and upper levels depending on direction of forward-and-back movement of the carriage.

Additional characteristics and advantages will become apparent from a detailed description, given here-below of a preferred embodiment to which various modifications and improvements can be made without departing from the scope of the invention.

To facilitate understanding the invention, the figures show only the elements necessary for the description of the invention.

DETAILED DESCRIPTION OF THE INVENTION

Figure 1:
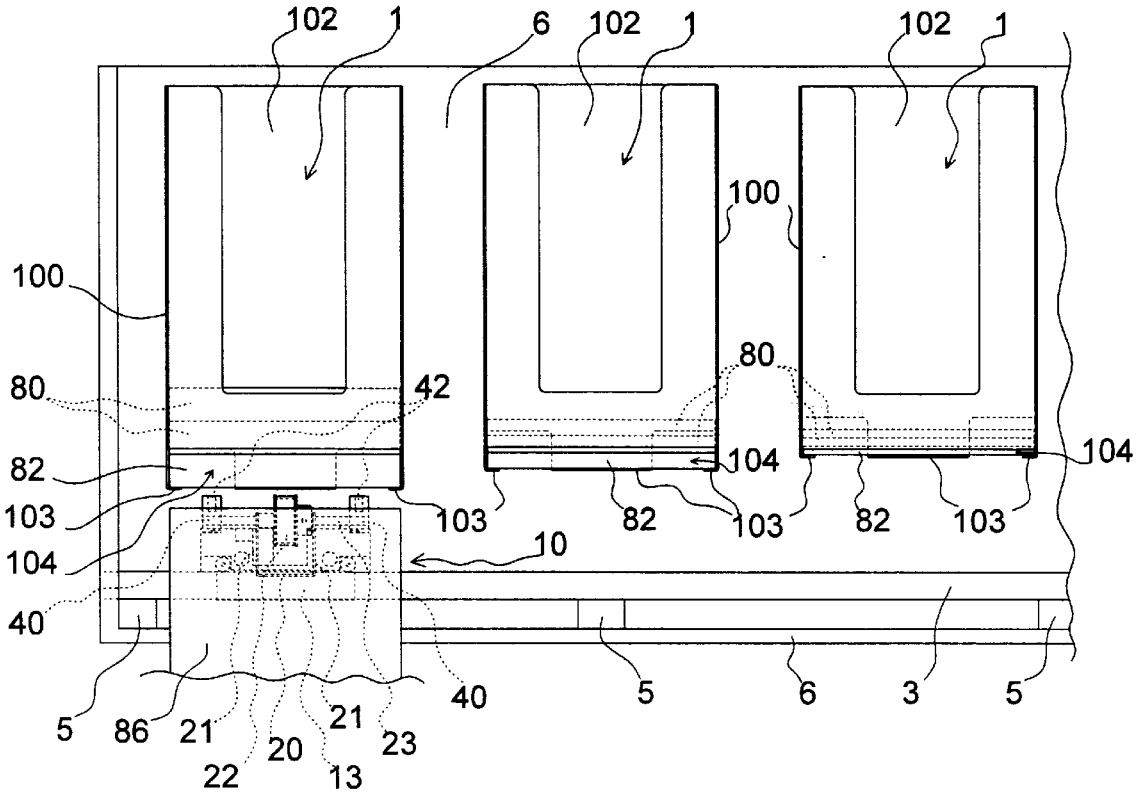
FIG. 1 is a simplified partial front view of a dispensing apparatus incorporating the dispensing device of the invention, in its inactive position associated with several storage compartments.

Referring to FIG. 1, a dispensing apparatus comprises several adjacent storage compartments 1 attached by their rear edges to a frame 6, each containing about thirty articles; in the described embodiment, the articles are boxes 80 in stacks in the compartments 1, the boxes being of parallelepipedic shape each storing an optical disc such as a compact disc or CD, CD-Rom, CD-W, DVD, or the like. While the storage compartments 1 are shown in FIG. 1 side-by-side, they can be arranged radially or in other lateral arrangements, as desired.

Each compartment 1 is made of a metal sheet 100 formed to provide four sides, the front one incorporating a central slot 102 allowing an easy insertion or removal by hand of articles and at its bottom an aperture 104 (FIG. 2) allowing the translation outside the compartment of one article at a time for delivery, herein shown as the lowermost article 82 in the stack in one of the adjacent compartments 1, by a dispensing device 10; both lateral and back sides have at their lower ends bent portions providing bottom members 103 on which rest the lowermost article 82 in the compartment 1, and the back side has a wide opening at the bottom to allow engagement by the dispensing device 10 with the lowest articles in the stack.

In accordance with the invention the dispensing device 10 is mobile and is mounted below the storage compartments 1. As shown on FIGS. 1–3, two coplanar guiding elements such as tubes 2, 3 attached to the frame 6 by legs 4, 5 support the dispensing device 10 for movement laterally along the guiding elements 2,3 in-between compartments into position below any one of the compartments 1.

The dispensing device 10 includes supports 12, 13 made of two parts bearing respectively on the tubes 2, 3 through rollers 7 and held at a fixed spacing by two guiding tubes 14, 15 perpendicular to the tubes 2,3. As shown on FIG. 2, the support 12 has an inverted "U" profile while the support 13 has an inverted "L" profile to allow an easy setting on or removal of the device 10 from the tubes 2, 3. To install the device 10, one has to simply set the support 13 around the tube 3 then drop the support 12 on the tube 2.

In the disclosed preferred embodiment, the supports 12, 13 are made of plastic such as Delrin and bear metallic rollers 7 pressing against the metallic tubes 2, 3 connected respectively to the positive, negative pole of a power supply. Accordingly, electric power is conveyed to the mobile dispensing device 10 via the metallic rollers 7 which serve as shoes to conduct electric current through leads to a reversible electric drive motor (schematically shown in dashed lines in FIG. 2) mounted on the left support 12 of the dispensing device 10 without using any exposed wire connectors, which is an advantage for a mobile element which is thus made autonomous.

Figure 1A:
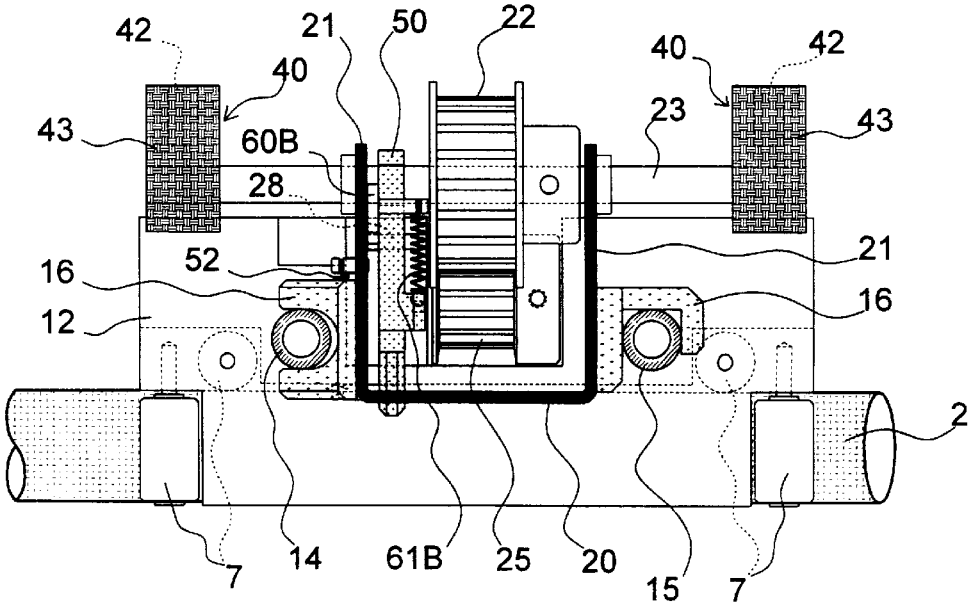
FIG. 1A is a sectional view, at a larger scale, of the dispensing device shown on FIG. 1 along the section 1A—1A of FIG. 3, the belt being omitted.

As shown on FIG. 1A, the dispensing device 10 includes a mobile U-shaped carriage 20 with its two lateral vertical edges 21 bearing on so that the carriage is longitudinally guided for movement along the tubes 14, 15, by virtue of legs 16. It bears a control element such as a control shaft 23 linked to a driving element such as a pulley 22. The pulley 22 is preferably a timed pulley driven by an endless timing helt 24 (FIGS. 2, 3) guided by two identical timing pulleys 25, 25' mounted for rotation on respective supports 12, 13. The pulley 25 on the support 12 is the driving pulley as its shaft 26 is rotated through a gear train (not shown) powered by the reversible electric drive motor (shown in dashed lines) so that the driving pulley 25 and the belt 24 can rotate in opposite directions (arrows F, G). The pulley 25' on the support 13 is the return pulley, its shaft being freely supported by resilient means (not shown) to keep the belt 24 tightened. The carriage 20 can be moved forward-and-back along the same longitudinal path on the tubes 14, 15 in-between the supports 12, 13.

Figure 2:
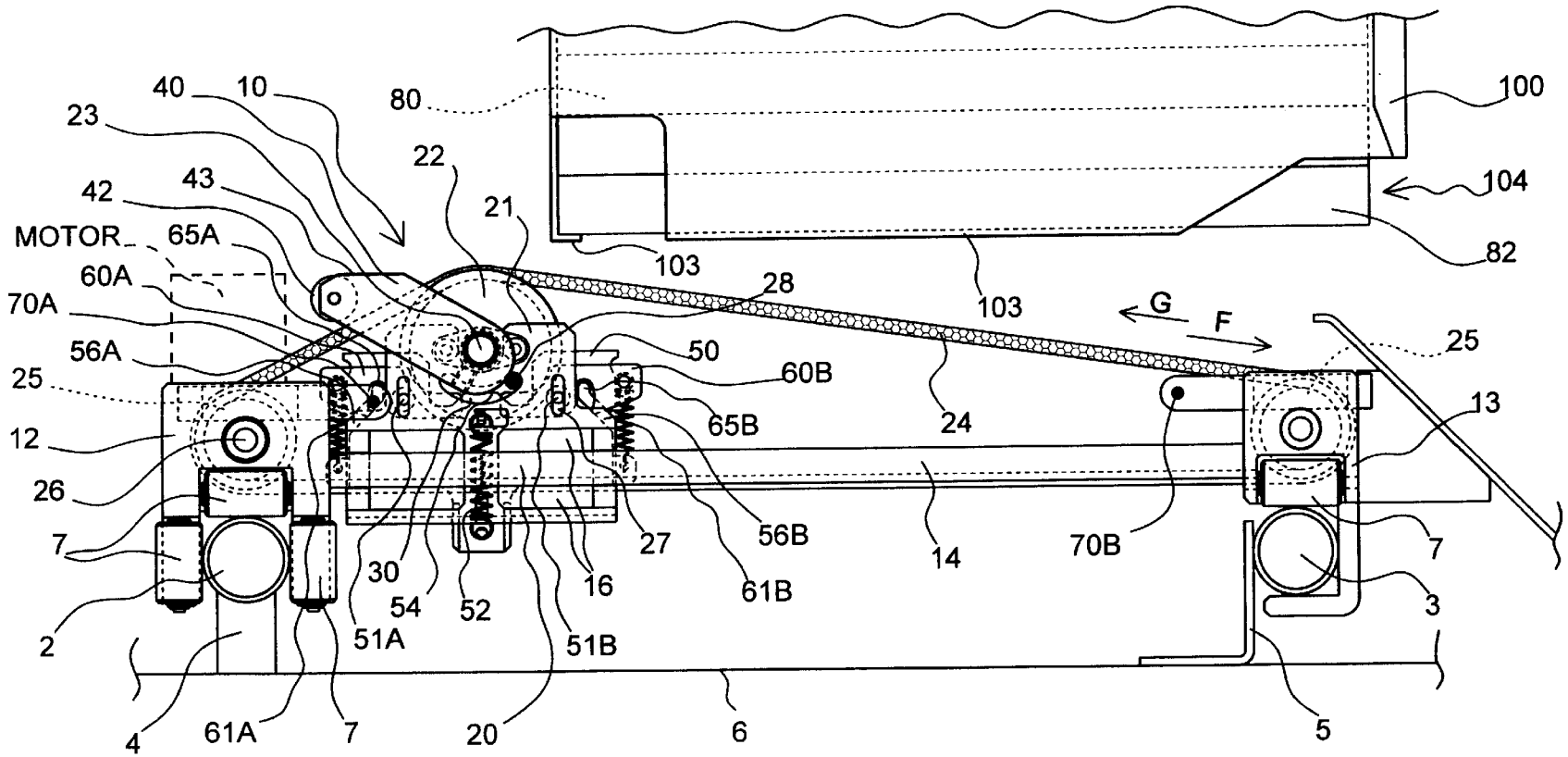
FIG. 2 is a lateral view, at a larger scale, of the dispensing device shown on FIG. 1.
Figure 3:
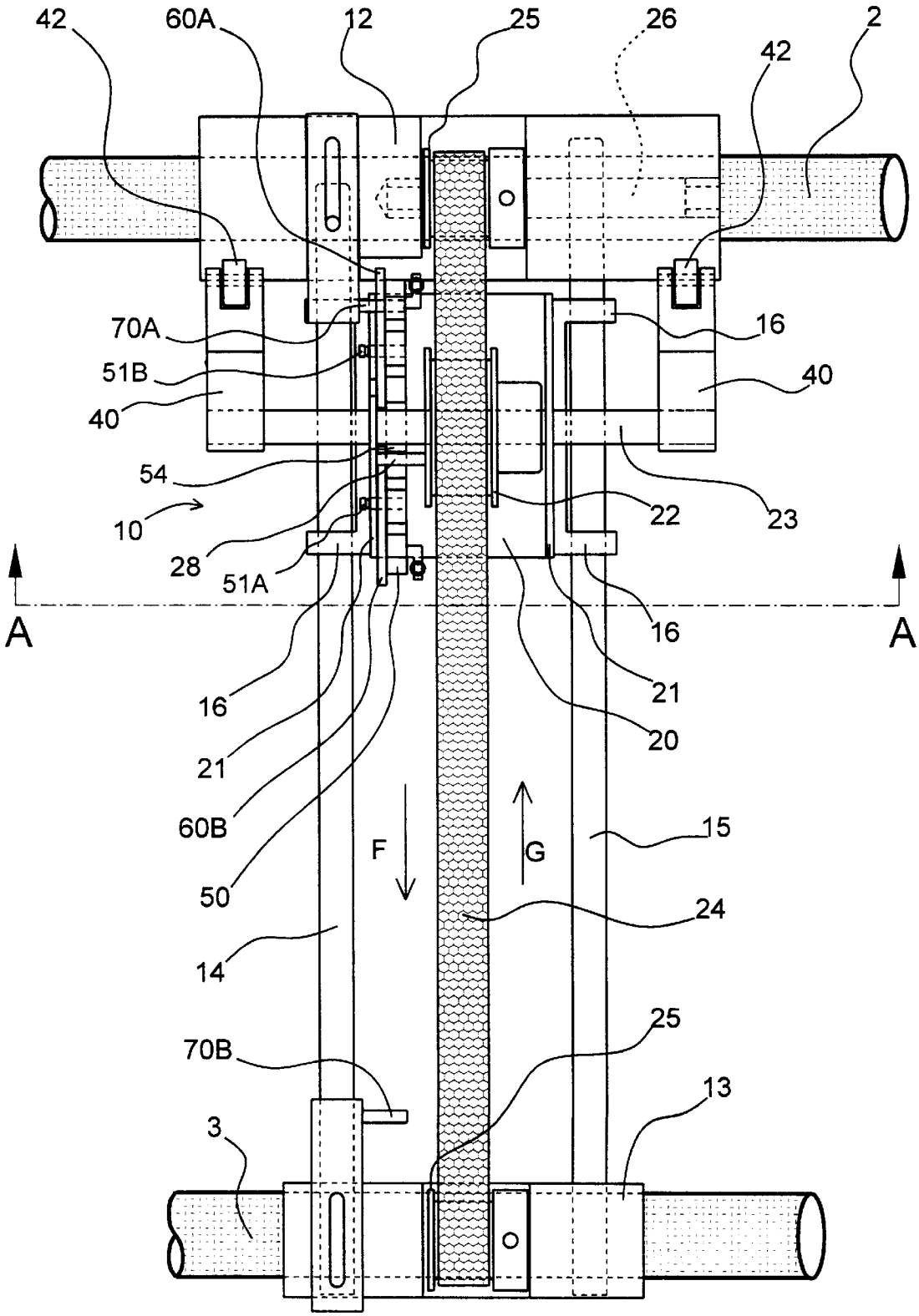
FIG. 3 is a top view of the dispensing device shown on FIG. 2, the storage compartment being omitted.
Figure 4:
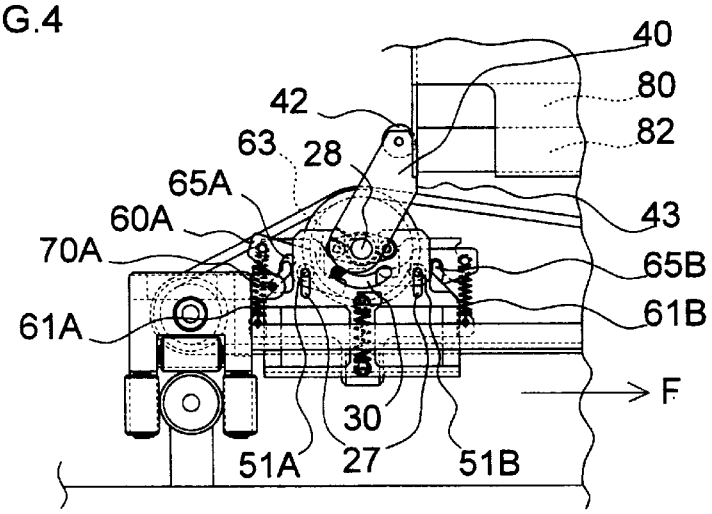
FIG. 4 is a similar view to FIG. 2 but fragmentary, at a smaller scale, the dispensing device being active to dispense an article from a compartment.

In carrying out the invention, to translate the lowermost article 82 in the stack of articles in one compartment 1 by forward translation of the carriage 20, referring to FIG. 2, a pair of laterally spaced fingers 40 are fixed to the control shat 23 so as to rotate with the control shaft as it is rotated by the drive motor from a lower level shown in FIG. 2, to an upper level shown in FIG. 4 in which the fingers 40 are engageable through an opening in the back side of the compartment 1 with the lowermost article 82 in the stack and move the article 82 toward the aperture 104 upon forward translation of the carriage 20. In furtherance of the invention, the rotational movement of the fingers 40 is limited by means 28 such as a stud mounted on the pulley 22 and engaging an arcuate opening 30 (FIGS. 2, 3, 7A) of about 90 degrees provided in the adjacent lateral edge 21. This lateral edge 21 also supports a plate 50 mounted for vertical movement by studs 51A, 51B provided on said plate 50 and cooperating with slots 27 in said lateral edge 21. At each lateral end, this plate 50 bears grooves 56A, 56B, mirror images of each other for cooperation with fixed elements, such as shafts 70A, 70B mounted on the supports 12, 13. This plate 50 undergoes the action of resilient means 52 moving it upwards and bears in-between itself and the lateral edge 21 two locking elements, such as ratchets 60A, 60B (FIGS. 1A, 3, 7B) mounted for free rotation on said studs 51A, 51B. Each ratchet includes on its end projecting from the carriage 20 a groove 65A,65B, respectively, proximate the level of the grooves 56A,56B, respectively, in the plate 50 for cooperating also with the shafts 70A,70B, respectively, and undergoes the action of resilient means 61A, 61B attached to the frame 20 which pivots it clockwise or anti-clockwise. The opposite end of each ratchet 60A, 60B has an edge 63 acted upon by the stud 28.

In the inactive position shown on FIGS. 2, 3, the carriage 20 is locked to the support 12 as the groove 65A of the ratchet 60A surrounds the shaft 70A. All the above-described elements being under the bottom members 103 of the compartments 1, and free from interference with the compartments 1, notably the fingers 40 which are at their lower level, the dispensing device 10 can be freely moved laterally on the tubes 2, 3, in a well-known manner (by cable, autonomous gear drive, or the like, not shown) relative to the compartments 1 to allow the dispensing device 10 to be positioned under any one compartment 1.

To operate the dispensing device 10 to dispense an article such as a box 82 from any compartment 1 when it is positioned therebelow, the drive motor powering the driving pulley 25 is switched on to drive it clockwise (FIG. 2, arrow F). The belt 24 rotates the pulley 22 and the shaft 23 clockwise which displace the stud 28 from the right extremity of the opening 30 to its left one (FIG. 4) . During this movement, the stud 28 which bears against the edge 54 of a profile provided on the plate 50 drives said plate downwards so that its groove 56A surrounds the shaft 70A to keep the carriage 20 locked on the support 12 (FIG. 2). Simultaneously, the fingers 40 pivot clockwise towards their upper level (FIG. 4) where they are almost upright, then the stud 28 bears on the edge 63 of the ratchet 60A (FIG. 7A) to pivot it clockwise so that its groove 65A leaves the shaft 70A. Near its end of movement, the stud 28 lets the resilient means 52 move the plate 50 upwards so that the groove 56A also leaves the shaft 70A with the result that the carriage 20 is now fully unlocked from the shaft 70A (FIG. 4). The stud 28 having reached the left extremity of the opening 30, the rotation of the pulley 22 is stopped but as the notches of the belt 24 engage the axial grooves in the pulley 22 (FIGS. 7A, 7B), the movement of the belt 24 ensures the translation of the carriage 20 on the tubes 14, 15.

Figure 5:
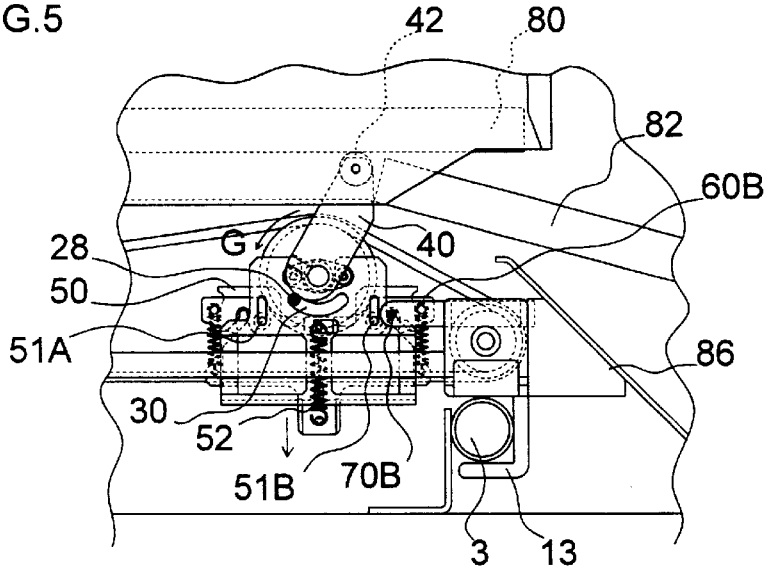
FIG. 5 is a similar view to FIG. 4, the dispensing device having dispensed an article.

In carrying out the invention, the fingers 40 each bear at their outer ends a freely revolving roller 42 the periphery of which extends slightly above the top level of the fingers 40 and the top of the lowermost article 82. The rollers 42 each provide a leading edge which is located, with the fingers 40 in their upper level position as shown in FIG. 4, to engage the back bottom corner of the penultimate article 80. This engagement by the periphery of the rollers 42 with the penultimate article 80 desirably occurs substantially simultaneously with engagement by the forward sides of the fingers 40 with the lowermost article 82, upon forward translation of the carriage 20 to dispense the lowermost article 82 from the compartment 1. This causes the penultimate article to be lifted slightly away from the lowermost article 82 (FIG. 5) to raise the stack from fully bearing on the lowermost article 82 as the lowermost article 82 is engaged by the fingers 40 and translated through the aperture 104.

This cooperative arrangement makes the translation of the article 82 easier as it does not undergo directly the weight of all the articles 80 in the stack. Furthermore the force required to be applied to the individual article 82 by the forward sides of the fingers 40 to translate the article is less, and the force applied to the top of the lowermost article 82 by the penultimate article 80 is less, reducing the risk of abrading, tearing or damaging the surfaces of the articles or packaging covering the surfaces of the articles, which may be light plastic film or the like. The required torque to operate the fingers 40 is then lower and the rollers pushed by the weight of the articles 80 in the stack, force the stud 28 against the left extremity of the opening 30 as the rollers 42 and the stud 28 are advantageously set on opposite sides of a vertical plane when the finger is in its raised past-vertical position, thus locking the stud 28 against the end of the slot and the fingers 40 at their upper level.

Figure 7A:
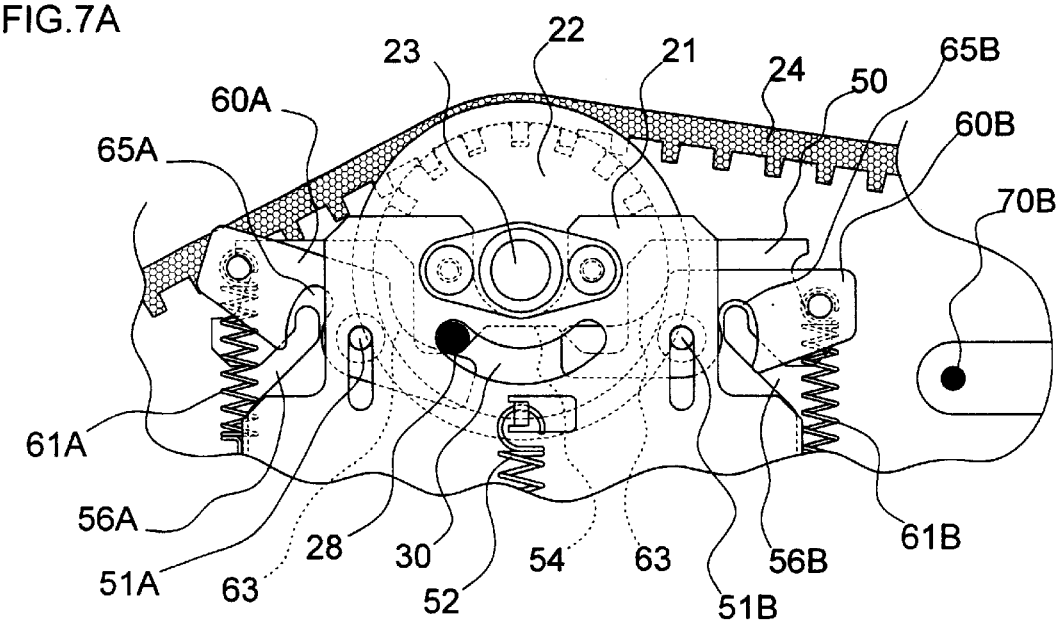
FIG. 7A is a detailed view at a larger scale of some elements shown on FIG. 4.
Figure 7B:
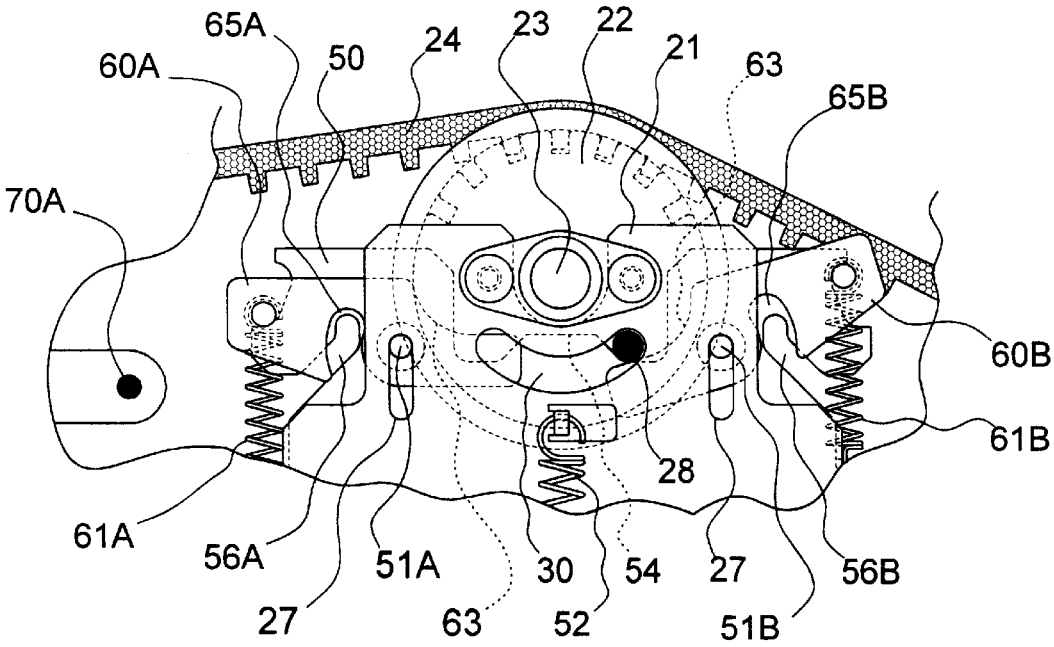
FIG. 7B is a similar view to FIG. 7A, the elements being in the position of FIG. 6.

When the carriage 20 comes near the support 13, the ratchet 60B which is in the position shown on FIG. 7A, as undergoing just the action of its resilient means 61B is pivoted by the shaft 70B and then its groove 65B surrounds the shaft 70B resulting in the locking of the carriage 20 to the support 13 (FIG. 5); meanwhile, the lowermost article or box 82 has been dispensed from the compartment 1 to slide on a support tray 86 for delivery to the user. Simultaneously, the carriage 20 powers a magnetic switch (not shown) on the support 13 which inverts the polarity of the motor driving the belt 24. The belt 24 and the pulley 22 now rotate anti-clockwise (arrow G) and the carriage 20 being still locked in the position shown on FIG. 5, the stud 28 moves in the opening 30 from the left (FIG. 7A) to the right (FIG. 7B) and this moves first the plate 50 downwards so that its groove 56B surrounds the shaft 70B while the fingers 40 are shifted back to their low level, thus allowing a downward movement of all the boxes within the compartment 1 so that the lowermost box 82 now rests on the bottom members 103. Then, the dispensing device 10 can be translated on the tubes 2, 3 for being positioned under any compartment 1.

Figure 6:
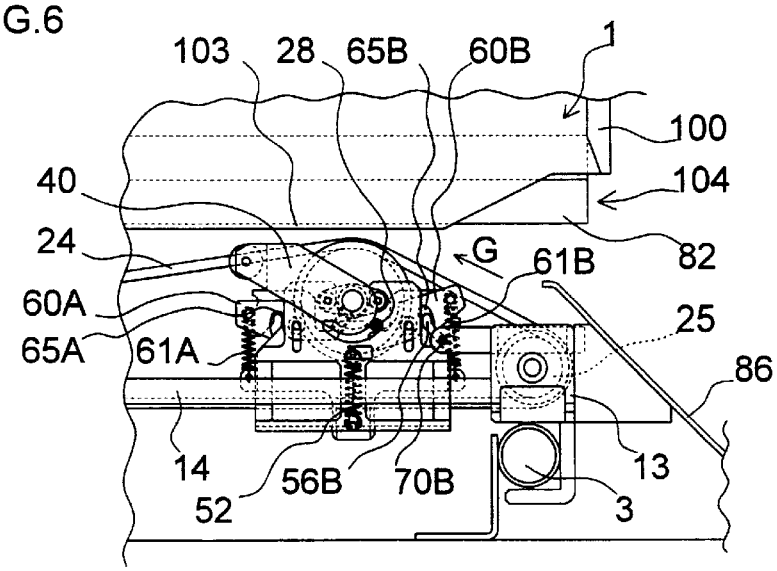
FIG. 6 is a similar view to FIG. 5, the dispensing device having been returned to its inactive position.

Simultaneously, by engaging the edge 63 of the ratchet 60B, the stud 28 pivots the groove 65B away from the shaft 70B, then allows the plate 50 to move upwards for releasing its groove 56B from the shaft 70B (FIG. 6). Thus, the carriage 20 is unlocked and as the rotation of the pulley 22 is stopped because the opening 30 stops the stud 28, the belt 24 translates the carriage 20 back to the support 12 (arrow G, FIGS. 2, 6). When the carriage 20 is close to the support 12, it drives a magnetic switch which inverts the polarity of the motor and switches it off while the groove 65A of the ratchet 60A locks it on the shaft 70A. The dispensing device 10 is then ready for a new cycle of operations.

As one can easily understand, the forward-and-back translation of the carriage 20 can be interrupted at any time because when it is powered again, it will keep on the same movement until actuating one of the end-of-movement switches. On another hand, as the belt 24 is a timing belt, the synchronism of all phases of the cycle is guaranteed but other means, such as for instance a chain, can he used.

The described dispensing device can handle articles of different thicknesses due to the possibility of changing the height of the front side 43 of the fingers 40 cooperating with the lowermost article 82. To this end, the tubes 2, 3 are set at a level such that the device 10 freely moves under the compartment 1 storing the thickest articles, any compartment storing thinner articles being set on the frame 6 at a level such that the rollers 42 reach the level of the bottom of the penultimate article 80 stored in each compartment.

In a prototype constructed as shown on FIG. 1, the compartments fixed on the frame 6 store boxes for CD, CD-Rom of the standard thickness (compartment 1 set in the middle) so-called "album" boxes, while the compartment 1 at the left-hand side stores the so-called "double album" boxes of a thickness almost double that of the "album" boxes and the compartment 1 at the right-hand side stores the so-called "single" boxes for "single" discs which have a thickness almost half that of the "album" boxes while another compartment can store discs stored in card boxes or envelopes which are of a thickness almost one third that of an "album" box.

In the preferred embodiment, the compartments 1 are attached to the frame 6 by eccentric cams having four preset positions so that their rotation provides the appropriate level setting for the type of CD box that it stores. In another embodiment, all the compartments are set at the same level and all have the same large front aperture 104 for the thickest box while wedges or holders of appropriate thickness are set on or attached to the bottom members 103 of the concerned compartments 1 to compensate for the difference in thickness of the boxes.

Further, there is no need, an in any prior art device, of safety means preventing the withdrawal of more than one article from one storage compartment at a time because the dispensing device of the invention can be associated with only one compartment at a time.

While in the description, the plane of the tubes 14, 15 and the plane in which the dispensing device 10 and the carriage 20 move, are depicted as horizontal planes, it should be understood that it is because the bottom of the articles 80, 82 rest on the bottom members 103 which are horizontal; the compartments 1 are shown vertically oriented. If desired, those planes can be oriented differently provided they are substantially parallel to that of the bottom members 103.

What is claimed is:

1. Apparatus for storing and dispensing articles comprising:

a compartment in which articles are stored in a stack, the compartment having a bottom aperture, a dispensing device including:

a mobile carriage translatable forward-and-back along substantially a same longitudinal path below said compartment between longitudinally spaced first and second positions, a finger mounted on the mobile carriage for movement between a lower level where it is free of interference with the compartment and an upper level where it is engageable with the lowermost article in said compartment to translate the article through the aperture upon forward translation of the carriage, a roller mounted on an outer end of the finger having a periphery which engages and lifts a penultimate article in said compartment to raise the stack from fully bearing on the lowermost article when the lowermost article is engaged by the finger upon forward translation of the carriage to translate it through the aperture, a driving member which translates the carriage forward-and-back, and a control element on the carriage which shifts the finger between its lower and upper levels depending on direction of forward-and-back translation of the carriage.

2. The apparatus according to claim 1 wherein the periphery of the roller provides a leading edge which engages the penultimate article substantially simultaneously with engagement by the finger with the lowermost article upon forward translation of the mobile carriage to dispense the lowermost article.

3. The apparatus according to claim 1 wherein a driving motor is mounted on the dispensing device and linked to the mobile carriage to translate the mobile carriage forward-and-back and to operate the control element to shift the finger between its lower and upper positions.

4. The apparatus according to claim 1 which includes locking elements which lock the carriage in its first and second positions while the finger is shifted between its lower and upper levels.

5. The apparatus according to claim 1 wherein the driving member is a reversible motor mounted on the dispensing device and linked to the carriage.

6. The apparatus according to claim 5 wherein the driving member is a reversible electric which is supplied with power from a power source providing an autonomous dispensing device.

7. The apparatus according to claim 5 wherein the control element is a rotary control shaft rotated by the reversible motor in one direction to raise the finger or in the opposite direction to lower the finger between its lower and upper levels.

8. The apparatus according to claim 6 wherein the driving motor is linked to the carriage by a timing pulley and belt drive including a timing pulley mounted to the control shaft on the carriage.

9. Apparatus for storing and dispensing articles comprising:

adjacent compartments in which articles are stored in a stack, each compartment having a bottom aperture, a dispensing device movable in-between compartments including:

a mobile carriage translatable forward-and-back below any one of said compartments between longitudinally spaced first and second positions, a finger mounted on the mobile carriage for movement between a lower level and an upper level where the lowermost article in the stack is engaged by the finger upon forward translation of the carriage to translate it through the bottom aperture, a roller mounted on an outer end of the finger having a periphery which engages and lifts a penultimate article in the stack to raise the stack from fully bearing on the lowermost article when the lowermost article is engaged by the finger upon forward translation of the carriage to translate it through the bottom aperture, a driving member which translates the carriage forward-and-back, and a control element on the carriage which shifts the finger between its lower and upper levels depending on direction of forward-and-back translation of the carriage so that the finger is shifted to its upper level upon forward translation of the carriage and is shifted to its lower level which is spaced below said compartments to be free of interference therewith when the carriage is being translated back to the first position or the dispensing device is being shifted in-between compartments.

10. The apparatus according to claim 9 which includes locking elements which lock the carriage in its first and second positions while the finger is shifted between its lower and upper levels.

11. The apparatus according to claim 10 wherein the driving member comprises a reversible motor which is linked to the carriage and actuates a first locking element to lock the carriage in the first position and raises the finger upon rotation of the motor in one direction, and which actuates the first locking element to unlock the carriage and translates the carriage forward toward the second position upon continued rotation of the motor in said one direction to dispense the lowermost article from the one compartment.

12. The apparatus according to claim 11 wherein the driving member actuates a second locking element to lock the carriage in the second position after the lowermost article is dispensed and lowers the finger to its lower level upon rotation of the motor in the reverse direction, and which actuates the second locking element to unlock the carriage and translates the carriage back toward the first position upon continued rotation of the motor in the reverse direction.

13. The apparatus according to claim 10 wherein the finger is raised from its lower to its upper level and lowered to its lower level when the locking elements are actuated to lock the carriage in its first and second positions, respectively.

14. The apparatus according to claim 9 wherein the driving member is a reversible motor and wherein first and second locking elements are included to lock the carriage in its first and second positions while the finger is raised and lowered, and to unlock the carriage to allow the carriage to be translated forward-and-back.

15. Apparatus for storing and dispensing articles comprising:

a compartment in which articles are stored in a stack, the compartment having a bottom aperture, a dispensing device including:

a mobile carriage translatable forward-and-back below said compartment between longitudinally spaced first and second positions, a finger mounted on the mobile carriage for movement between a lower level and an upper level, a roller mounted on an outer end of the finger having a periphery which engages and lifts a penultimate article in said compartment to raise the stack from fully bearing on the lowermost article when the lowermost article is engaged by the finger upon forward translation of the carriage to translate it through the aperture, a driving member which translates the carriage forward-and-back, a control element on the carriage which shifts the finger between its lower and upper levels depending on direction of forward-and-back translation of the carriage, the finger being shifted to a raised past-vertical position at its upper level upon forward translation of the carriage and being shifted to a lowered position at its lower level which is spaced below the compartment to be free of interference therewith upon translation of the carriage back toward the first position, and a member having a stud engaging a slot in a fixed member on the carriage, the slot having an end which limits movement of the stud and defines the raised past-vertical position of the finger, the end of the slot and the roller on the finger being on opposite sides of a vertical plane when the finger is in the raised position so that all weight of the stack of articles in the compartment borne by the roller and supported by the finger locks the stud against the end of the slot and the finger in the raised position.

16. Apparatus for storing and dispensing articles comprising:

a compartment in which articles are stored in a stack, the compartment having a bottom aperture, a dispensing device including:

a mobile carriage translatable forward-and-back below said compartment between longitudinally spaced first and second positions, a finger mounted on the mobile carriage for movement between a lower level and an upper level, a roller mounted on an outer end of the finger having a periphery which engages and lifts a penultimate article in said compartment to raise the stack from fully bearing on the lowermost article when the lowermost article is engaged by the finger upon forward translation of the carriage to translate it through the aperture, a driving member which translates the carriage forward-and-back, a control element on the carriage which shifts the finger between its lower and upper levels depending on direction of forward-and-back translation of the carriage, the finger being shifted to a raised past-vertical position at its upper level upon forward translation of the carriage and being shifted to a lowered position at its lower level which is spaced below the compartment to be free of interference therewith upon translation of the carriage back toward the first position, and means including a stud connected to the control element engaging a slot on the carriage for limiting the movement of the control element so that the driving member operates both the finger and the carriage.

17. Apparatus for dispensing articles of regular shape, such as boxes, from adjacent compartments in which articles are stored in stacks, each of the compartments having a bottom aperture, said apparatus comprising:

a dispensing device mounted below for movement laterally in-between the compartments and including a mobile carriage supported for translation longitudinally forward-and-back below one compartment when positioned therebelow, a reversible electric motor connected to the carriage by a timing pulley and belt drive including a timing pulley attached to a control shaft on the carriage which has an unlocked position and a locked position, a pair of fingers mounted to the rotary control shaft which when in the unlocked position shifts the fingers between lower and upper levels depending on direction of rotation of the carriage-pulley by the motor, the mobile carriage being translated forward-and-back by the motor when the control shaft is in the locked position depending on direction of rotation of the motor, the fingers when in the upper level being engageable with the lowermost article in the one compartment to dispense the lowermost article through a bottom aperture in the compartment upon forward translation of the carriage, and when in the lower level being free of interference with the compartments for back translation of the carriage or movement of the dispensing device in-between compartments, and rollers mounted on outer ends of the fingers so that a penultimate article is engaged and lifted by the rollers to raise the stack from fully bearing on the lowermost article upon forward translation of the carriage when the lowermost article is engaged by the fingers and translated through the aperture.

* * * * *